US005632526A

United States Patent [19]

McLarty, III et al.

[11] Patent Number: 5,632,526

[45] Date of Patent: *May 27, 1997

[54] WARP KNIT WEFT-INSERTION ELASTOMERIC FABRIC

[75] Inventors: George C. McLarty, III, Greenville; Anthony R. Waldrop, Easley; Kathryn T. Anderson, Greenville, all of S.C.

[73] Assignee: Milliken Research Corporation, Spartanburg, S.C.

[ * ] Notice: The term of this patent shall not extend beyond the expiration date of Pat. No. 5,533,789.

[21] Appl. No.: 630,381

[22] Filed: Apr. 10, 1996

Related U.S. Application Data

[63] Continuation of Ser. No. 339,260, Nov. 10, 1994, Pat. No. 5,533,789.

[51] Int. Cl.[6] ..... A47C 7/02

[52] U.S. Cl. ..... 297/452.64; 297/452.56; 297/284.1; 66/192; 66/195; 66/170; 57/225

[58] Field of Search ..... 297/452.64, 452.56, 297/284.1; 66/170, 192, 195, 202, 196; 57/225; 428/253, 229, 230, 231

[56] References Cited

U.S. PATENT DOCUMENTS

| | | | |
|---|---|---|---|
| 2,236,758 | 4/1941 | Lumsden | 66/190 |
| 2,251,318 | 8/1941 | Blair et al. | 155/179 |
| 2,254,131 | 8/1941 | Anton | 66/190 |
| 2,345,055 | 3/1944 | Lilley et al. | 66/190 |
| 2,378,780 | 6/1945 | Lombardi | 66/190 |
| 2,581,322 | 1/1952 | Fox | 66/190 |
| 2,653,463 | 9/1953 | Crimmins | 66/190 |
| 3,226,796 | 1/1966 | Fox et al. | 428/231 X |
| 3,567,565 | 3/1971 | Jones et al. | 66/192 X |
| 3,592,025 | 7/1971 | Sharpe | 66/192 |
| 3,832,841 | 9/1974 | Cole | 428/230 X |
| 4,248,064 | 2/1981 | Odham | 66/192 |
| 4,470,250 | 9/1984 | Arenz et al. | 57/225 |
| 4,509,320 | 4/1985 | Maeda | 57/225 |
| 4,545,614 | 10/1985 | Abu-Isa et al. | 297/284 |
| 4,722,203 | 2/1988 | Darjee | 66/202 |
| 4,728,565 | 3/1988 | Fontana | 428/230 X |
| 4,761,035 | 8/1988 | Urai | 297/452 |
| 4,842,257 | 6/1989 | Abu-Isa et al. | 267/133 |
| 4,869,554 | 9/1989 | Abu-Isa et al. | 297/452 |
| 4,910,817 | 3/1990 | Kita | 297/452.56 X |
| 4,928,334 | 5/1990 | Kita | 5/191 |
| 4,990,158 | 2/1991 | Kaplan et al. | 57/225 X |
| 5,013,089 | 5/1991 | Abu-Isa et al. | 297/452 |
| 5,147,714 | 9/1992 | Ellison et al. | 66/195 X |
| 5,215,807 | 6/1993 | Day et al. | 66/170 X |
| 5,249,414 | 10/1993 | Iwata et al. | 57/225 |
| 5,265,445 | 11/1993 | Shytles et al. | 66/192 |
| 5,280,887 | 1/1994 | Fontana | 267/142 |
| 5,393,596 | 2/1995 | Tornero et al. | 66/192 X |
| 5,533,789 | 7/1996 | McLarty, III et al. | 297/452.64 |

FOREIGN PATENT DOCUMENTS

| | | | |
|---|---|---|---|
| 2431272 | 2/1980 | France . | |
| 3107816 | 9/1982 | Germany | 66/192 |
| 1179350 | 8/1986 | Japan | 66/192 |
| 2632203 | 12/1926 | United Kingdom | 66/192 |
| 2037828 | 7/1980 | United Kingdom | 66/170 |
| 2105379 | 3/1983 | United Kingdom | 66/170 |

*Primary Examiner*—Peter M. Cuomo
*Assistant Examiner*—Rodney B. White
*Attorney, Agent, or Firm*—Terry T. Moyer; James M. Robertson

[57] ABSTRACT

A seating structure including fabric support webs is provided. The seating structure includes a webbed support surface formed from a warp knit fabric with weft insertion of an elastomeric yarn. The stretch in the warp is substantially linear over a full range of applied stress from zero pounds to failure. The stretch in the weft has two substantially linear components wherein the first linear component operates over the range of zero to about 10 pounds applied force and the second linear component operates over the range of 10 pounds applied force to failure.

9 Claims, 3 Drawing Sheets

WARP KNIT WEFT-INSERTION ELASTOMERIC FABRIC

This is a continuation of patent application Ser. No. 08/337,260 filed Nov. 10, 1994, now U.S. Pat. No. 5,533, 789, filed in the name of George C. McLarty, III, Anthony R. Waldrop and Kathryn T. Anderson, specific reference being made herein to obtain the benefit of such filing date.

FIELD OF THE INVENTION

This invention relates generally to seating structures and more particularly to seating structures having support surfaces formed from resilient fabric without the need for underlying springs or cushion support structures.

BACKGROUND

Traditional seating structures such as for use in a vehicle, office environment or residential setting are formed from relatively thick urethane foam buns mounted on semi-flexible spring wire constructions. These foam buns are, in turn, typically covered with an aesthetically pleasing fabric cover for contacting the user. As will be readily appreciated, the use of such a multiplicity of components (i.e. springs, cushions and covers) all of which are attached to a frame gives rise to a relatively complicated assembly practice.

In order to reduce the number of components in seating structures and to reduce the bulk thereof, it has been proposed to provide thin profile seats, including thin seats using elastomeric seat backing material. For example, in U.S. Pat. No. 2,251,318 to Blair et al, solid rubber tape or strips reinforced by fabric are stretched over a seat frame. In U.S. Pat. No. 4,545,614 to Abu-Isa et al., (incorporated by reference) a thin profile vehicle seat is disclosed in which a multiplicity of side by side elastomeric filaments made from a block copolymer of polytetramethylene terephthalate polyester and polytetramethylene ether are stretched across a vehicle seat frame. U.S. Pat. No. 4,869,554 to Abu-Isa et al., issued Sep. 26, 1989 (incorporated by reference) discloses a thin profile seat in which elastomeric filaments like that of the U.S. Pat. No. 4,545,614 patent are woven together to form a mat. The mat was prestretched to at least 5 percent elongation and attached to a seat frame. U.S. Pat. No. 5,013,089 to Abu-Isa et al., (incorporated by reference) discloses a seat assembly having an elastomeric filament suspension and a fabric cover. The filament suspension and the fabric cover are integrated by having the elastomeric filaments and the fabric knitted together to provide a low profile finished seat or backrest.

The present invention provides a seating structure wherein the support surfaces (i.e. the seat and backrest) comprise a weft insertion knitted fabric which fabric can be formed in a single operation on one knitting machine. The fabric has an aesthetic side suitable for contacting the user of the seating structure. The structure of the fabric is such that it also has a performance side to provide the user with resilient support during repeated use. The present invention therefore represents a useful advancement over the state of the art.

OBJECTS AND SUMMARY

In light of the foregoing, it is a general object of the present invention to provide a seating structure having webbed support surfaces formed from a single knitted fabric structure.

It is an object of the present invention to provide a seating support structure having a webbed support surface formed from warp knit fabric wherein the fabric undergoes easy initial elongation in the weft direction while having relatively limited elongation in the warp direction.

It is a further object of the present invention to provide a seating structure having a webbed support surface displaying sufficient vertical ride upon use to provide comfort to the user while avoiding overextension of the support surface.

It is yet a further object of the present invention to provide a seating structure having a webbed support surface formed from a warp knit fabric with weft insertion wherein one side of the fabric yields desired structural performance characteristics while the opposite side is aesthetically pleasing.

In that respect it is a feature of the present invention to provide a seating structure having a webbed support surface formed from a warp knit fabric with weft insertion of an elastomeric yarn, wherein the warp stretch is substantially linear over a full range of applied stress from zero pounds to breaking and elongation of the filling has two substantially linear components wherein a first substantially linear high elongation component operates over the range of zero to about 10 pounds applied force and a second linear component operates over the range of about 10 pounds applied force to breaking.

Other objects, advantages and features of the invention will, of course, become apparent upon reading the following detailed description and upon reference to the drawings below.

DESCRIPTION

While the invention will be described in connection with certain preferred embodiments and procedures, it is to be appreciated that we do not intend to limit the invention to such embodiments and procedures. On the contrary, we intend to include all alternatives, modifications and equivalents as may be included within the true spirit and scope of the invention as defined by the appended claims.

Figure 1:
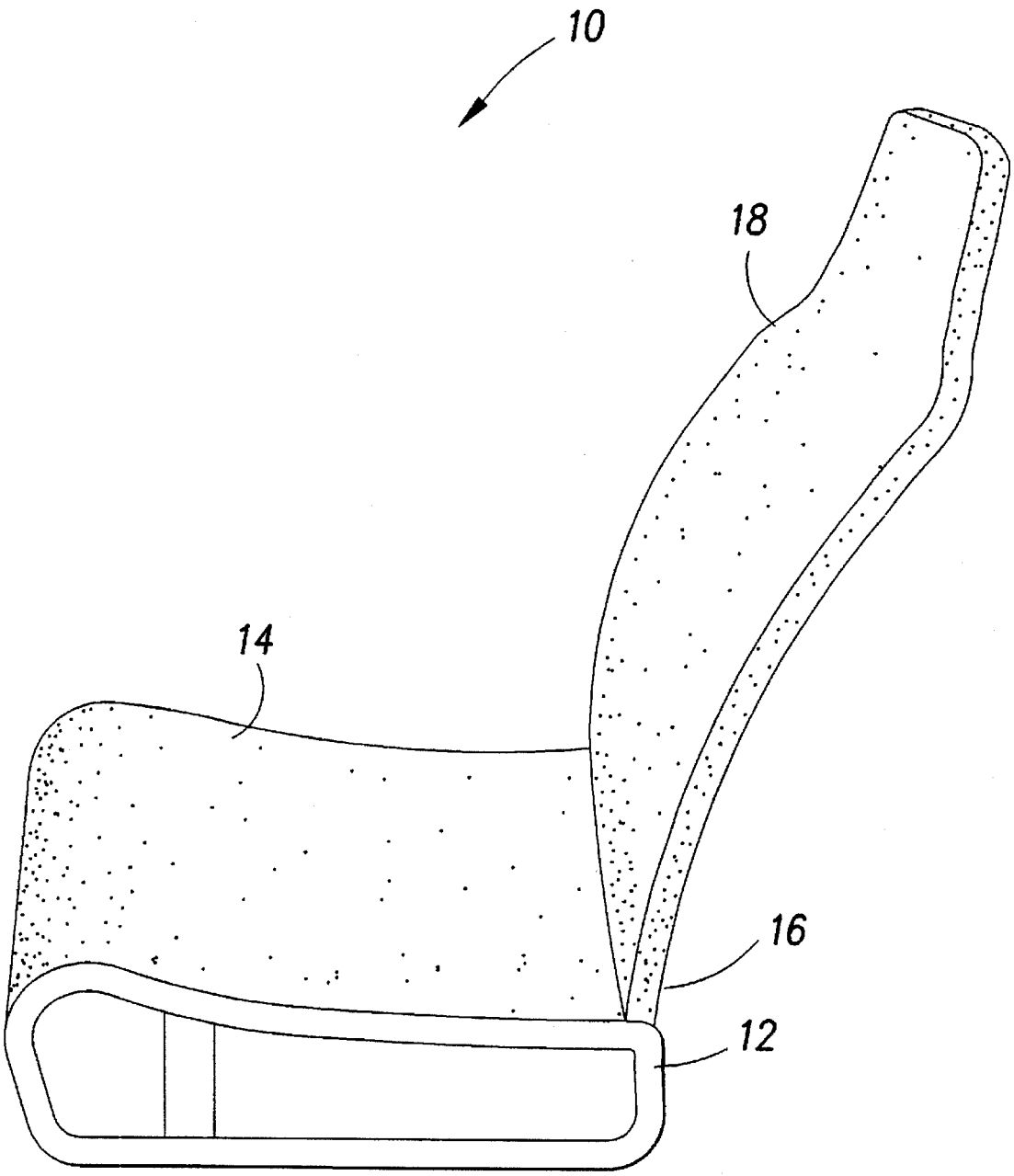
FIG. 1 is a perspective view of a seating structure according to the present invention.

Turning now to the drawings, in FIG. 1 there is shown a seating structure 10 according to the present invention such as may be used in an automobile, an office chair or a home environment. While the actual design of the seating structure 10 may be varied depending on environment of use and aesthetic preferences, in general the seating structure will preferably include a seating frame 12, a seating support web 14, a back frame 16 and a back support web 18. In the illustrated and preferred embodiment, the seating support web 14 and the back support web 18 are disposed in tension over the seating frame 12 and back frame 16 respectively without the need for added cushions or other support structures, although it is contemplated that such support structures could be utilized if desired.

As will be appreciated by those of skill in the art, the seating support web 14 and back support web 18 should be constructed to provide a so called "vertical ride" when a load is applied in the form of an occupant so that a feeling of support and comfort is provided. This feature in seating structures has historically been provided by the use of springs and cushions which compress in known repeatable fashion when loads are applied.

While some degree of movement is important to the impartation of comfort, such movement should also not be so extreme as to negate the feeling of support. Accordingly, it is important that any seating support structure have a limited degree of movement when loads are applied. As will be understood, the use of spring structures has historically been used in this function since the spring compression effectively limits movement when loads are applied.

Figure 2:
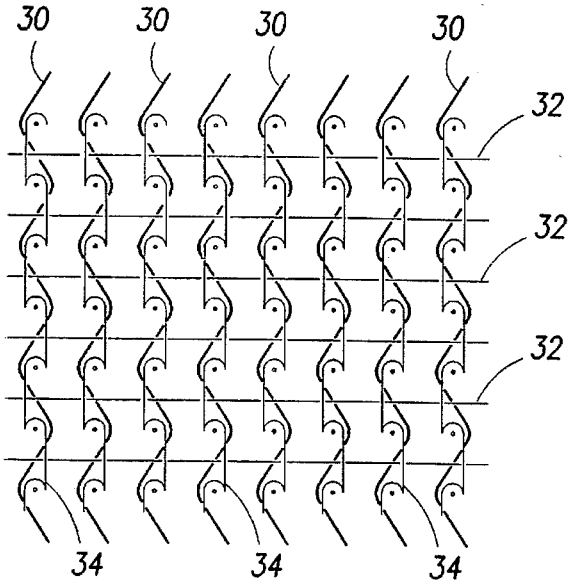
FIG. 2 is a needle bed point diagram illustrating a potentially preferred construction of the fabric used in the support surface of the seating structure of the present invention.
Figure 3:
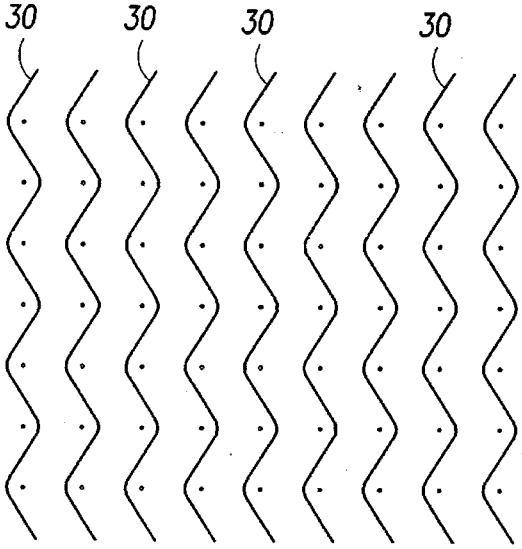
FIGS. 3–5 are needle bed point diagrams illustrating the components in the potentially preferred construction of the fabric as shown in FIG. 2.
Figure 4:
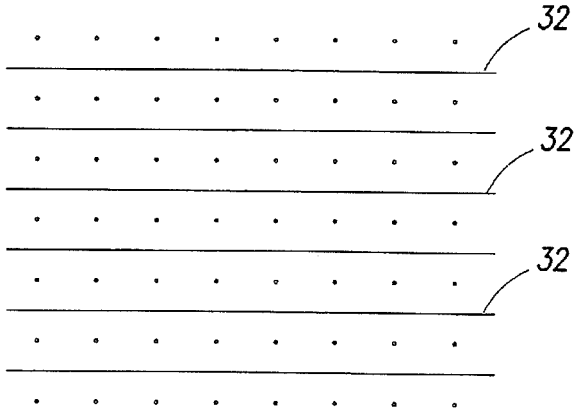
Figure 5:
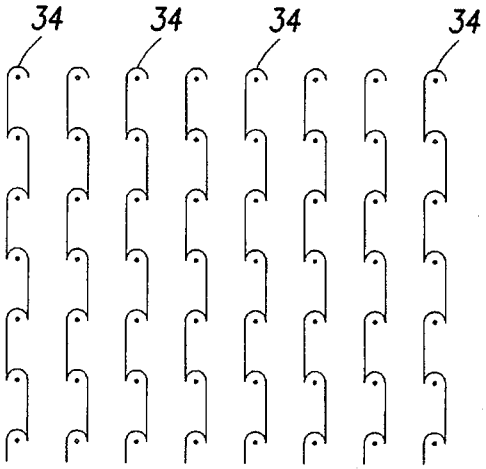

In order to provide a seating structure which has these desirable operational features while avoiding the need to use previously available complex support structures and still providing an aesthetically pleasing appearance, the present invention utilizes a weft-insertion fabric (FIG. 2) to form the seating support web 14 and back support web 18. As illustrated in the point diagrams FIGS. 3–5, this weft-insertion fabric preferably includes three components.

In the illustrated and preferred embodiment the components of the weft-insertion fabric are an elastomeric monofilament yarn 30 in the warp, a highly elastomeric filament yarn 32 wrapped for aesthetics and inserted in the weft and a knit filament yarn 34 which is used to tie the warp yarn and the weft-inserted yarn together at their intersections.

Figure 6:
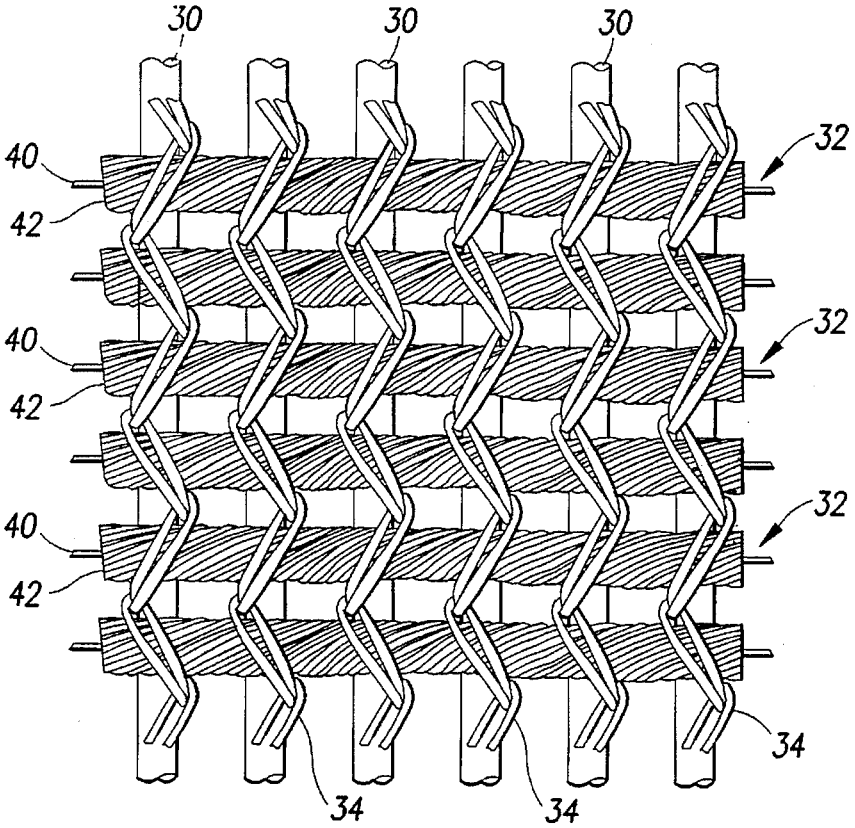
FIG. 6 is a view of the aesthetic side of the potentially preferred fabric for use in the support surface of the seating structure of the present invention.
Figure 7:
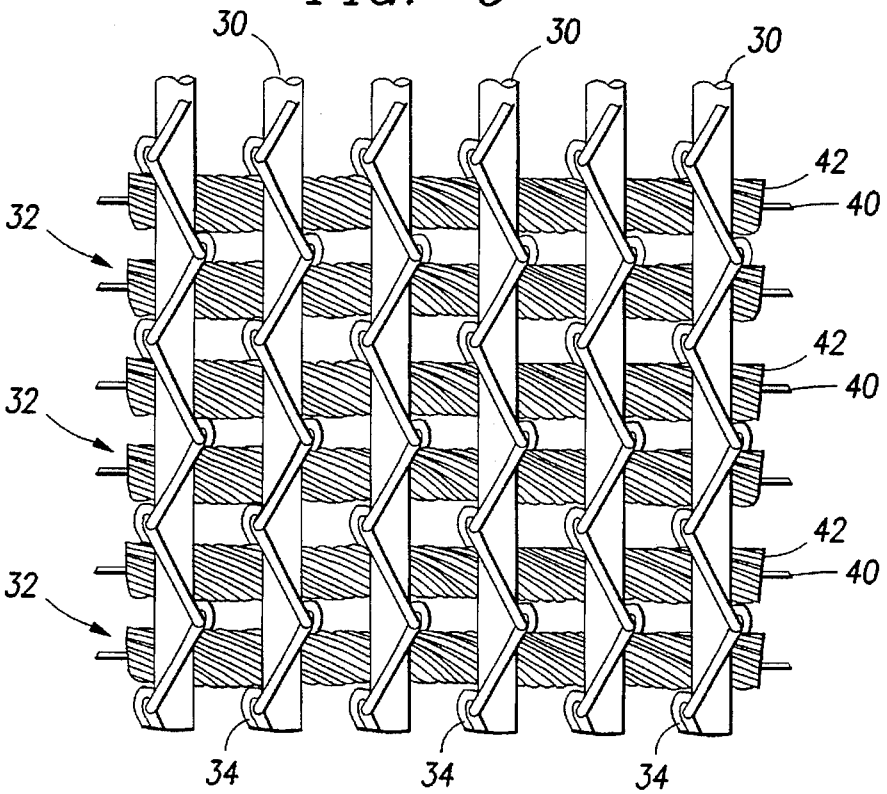
FIG. 7 is a view of the performance side of the potentially preferred fabric for use in the support surface of the seating structure of the present invention.

The face or aesthetic side of the resultant fabric is illustrated in FIG. 6, and the rear or performance side of the resultant fabric is illustrated in FIG. 7. In the illustrated and potentially preferred embodiment, the elastomeric monofilament yarns 30 are 2500 denier ELAS-TER™ monofilament yarn believed to be available from Hoechst Celanese Corporation whose business address is I-85 at Road 57, Spartanburg, S.C. 29303. The wrapped filament yarns 32 which are inserted in the weft preferably comprise a highly elastomeric core 40 formed from a material such as is available under the trade designation SPANDEX™ or the like. As shown, this elastomeric core 40 is preferably wrapped with an aesthetically pleasing yarn 42. One preferred composite of wrapped filament yarn 32 for weft insertion is available from World Elastic whose business address is believed to be 231 Pounds Avenue SW, Concord, N.C. 28025. The knit filament yarn 34 is preferably a solution dyed polyester of between about 100 and 250 denier and more preferably about 150 denier such as are well known to those of skill in the art although alternative materials may be utilized.

In the potentially preferred final fabric configuration, the elastomeric monofilament yarn 30 will be disposed at about 12 to about 32 ends per inch and more preferably 16 to 24 ends per inch and the weft-inserted wrapped filament yarns will be inserted at about 16 to about 40 picks per inch and more preferably 22 to 30 picks per inch.

In an important aspect of the present invention, it has been found that the use of a warp knit weft-insertion fabric as described above provides exceptional comfort and support in the support webs of the seating structure 10 without the need for any supplemental supports or resilient load carrying members. Tensile testing of this weft-insertion fabric according to ASTM D-5034 indicates that elongation in the warp direction is substantially linear up to failure. Specifically, such elongation has been measured to be in the range of between about 2 pounds force per percent elongation and about 4 pounds force per percent elongation.

In contrast to the linear stress strain relationship existing from initiation to failure in the warp direction, tensile tests in the weft direction indicate two separate linear regions. Specifically, the weft insertion configuration described above yields elongations of between about 25 and about 65 percent at a load of 10 pounds (i.e. 0.4 to 0.17 pounds force per percent elongation) followed by a relatively gradual linear region of elongation between about 10 pounds force and breaking with ratios of between about 2 and about 4 pounds force per percent elongation.

It can thus be appreciated that the use of weft-inserted fabrics as described above as the seating support web 14 and the back support web 18 in a seating structure 10, provides for initial limited displacement upon loading due to the elongation in the weft direction followed by steady support after such initial loading due to both the warp and the weft being in a region of linear elongation up to breaking. Moreover, the use of the weft-inserted fabric as described provides for an aesthetically pleasing surface by itself with no additional cover.

In accordance with the present invention, a useful seating structure can be formed by stretching a weft-inserted fabric as described over a seating frame and back frame without the need for any additional padding, springs or other support structures. Such seating structures thus represent an important and significant advancement over the present art.

What is claimed is:

1. A warp knit, weft-insertion elastomeric fabric structure having a performance side and an aesthetic side, the fabric structure comprising: a plurality of elastomeric monofilament yarns running in a first direction, said monofilament yarns lying in a first plane and forming the performance side of said fabric structure; a plurality of elastomeric wrapped filament yarns running in a second direction generally transverse to said first direction, said wrapped filament yarns lying in a second plane substantially parallel to said first plane and forming the aesthetic side of said fabric; and a plurality of knit filament yarns running between said first plane and said second plane and tying said elastomeric monofilament yarns to said elastomeric wrapped filament yarns.

2. The invention as in claim 1, wherein said elastomeric monofilament yarns are disposed in said fabric at a construction density of between about 12 and about 32 yarns per inch.

3. The invention as in claim 2, wherein said elastomeric monofilament yarns are disposed in said fabric at a construction density of between about 16 and about 24 yarns per inch.

4. The invention as in claim 2, wherein said wrapped filament yarns are disposed in said fabric at a construction density of between about 16 and about 40 yarns per inch.

5. The invention as in claim 2, wherein said wrapped filament yarns are disposed in said fabric at a construction density of between about 22 and about 30 yarns per inch.

6. The invention as in claim 1, wherein said elastomeric monofilament yarns are disposed in said fabric at a construction density of between about 16 and about 24 yarns per inch and wherein said wrapped filament yarns are disposed in said fabric at a construction density of between about 22 and about 30 yarns per inch.

7. The invention as in claim 1, wherein said knit filament yarns have a denier of between about 100 and about 250.

8. The invention as in claim 7, wherein said knit filament yarns are formed from solution dyed polyester.

9. A warp knit, weft-insertion elastomeric fabric structure having a performance side and an aesthetic side, the fabric structure comprising: a plurality of elastomeric monofilament yarns having a denier of about 2500 running in a first direction at a construction density of between about 12 and about 32 yarns per inch, said monofilament yarns lying in a first plane and forming the performance side of said fabric structure; a plurality of elastomeric wrapped filament yarns running in second direction generally transverse to said first direction at a construction density of between about 16 and about 24 yarns per inch, said elastomeric wrapped filament yarns lying in a second plane substantially parallel to said first plane and forming the aesthetic side of said fabric structure; and a plurality of knit filament yarns having a denier of between about 100 and about 250 running between said first plane and said second plane and tying said elastomeric monofilament yarns to said wrapped filament yarns.

* * * * *